US010790562B2

(12) United States Patent
Milroy et al.

(10) Patent No.: US 10,790,562 B2
(45) Date of Patent: Sep. 29, 2020

(54) COMPACT CONCENTRIC SPLIT RING WAVEGUIDE ROTARY JOINT

(71) Applicant: ThinKom Solutions, Inc, Hawthorne, CA (US)

(72) Inventors: William Milroy, Torrance, CA (US); Eugene Yum, Los Angeles, CA (US); William Henderson, Bedford, NH (US); James Treinen, Playa Del Rey, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 0 days.

(21) Appl. No.: 16/237,784

(22) Filed: Jan. 2, 2019

(65) Prior Publication Data

US 2020/0212528 A1 Jul. 2, 2020

(51) Int. Cl.

| | |
|---|---|
| ***H01P 1/06*** | (2006.01) |
| ***H01P 5/12*** | (2006.01) |
| ***H01P 1/02*** | (2006.01) |

(52) U.S. Cl.

CPC ..... *H01P 1/062* (2013.01); *H01P 1/027* (2013.01); *H01P 1/068* (2013.01); *H01P 5/12* (2013.01)

(58) Field of Classification Search

CPC ..... H01P 1/068; H01P 1/027; H01P 1/122; H01P 1/062; H01P 1/064; H01P 5/12

USPC ..... 333/105, 106, 108, 254, 256, 258, 259

See application file for complete search history.

(56) References Cited

U.S. PATENT DOCUMENTS

| | | | |
|---|---|---|---|
| 2,945,193 A | 7/1960 | Strom | |
| 4,533,887 A | 8/1985 | Morz et al. | |
| 9,979,061 B1 * | 5/2018 | Droz | H01P 3/16 |

FOREIGN PATENT DOCUMENTS

| | | |
|---|---|---|
| FR | 2984612 A1 | 6/2013 |
| WO | WO 2008/104998 A2 | 9/2008 |

OTHER PUBLICATIONS

Extended European Search Report dated May 15, 2020 from related/corresponding EP Application No. 19214339.4, filed Dec. 9, 2019.

* cited by examiner

*Primary Examiner* — Rakesh B Patel
*Assistant Examiner* — Jorge L Salazar, Jr.
(74) *Attorney, Agent, or Firm* — Kusner & Jaffe

(57) ABSTRACT

A waveguide rotary joint includes a first waveguide member comprising a first waveguide portion, and a second waveguide member comprising a second waveguide portion, the second waveguide member rotatably connected via a curved circumferential path to the first waveguide member, wherein the second waveguide portion is adjacent to the first waveguide portion to define a first split rectangular waveguide. A first waveguide input/output port is communicatively coupled to the first waveguide portion, and a second waveguide input/output port is communicatively coupled to the second waveguide portion. Relative rotation between the first waveguide member and the second waveguide member changes an angular length of the first waveguide connecting the first waveguide input/output port to the second waveguide input/output port.

17 Claims, 5 Drawing Sheets

SECTION B

COMPACT CONCENTRIC SPLIT RING WAVEGUIDE ROTARY JOINT

TECHNICAL FIELD

The present invention relates generally to waveguide rotary joints for use in antenna systems and, more particularly, to a split-ring waveguide rotary joint that is axially compact and provides a low-loss transition of a radio frequency (RF) signal from one device rotating relative to another device.

BACKGROUND ART

Numerous radar and RF communications applications require steering of an antenna in one or more axes to maintain tracking or pointing toward an intended target or communications link. Such steering is frequently accomplished by mounting the antenna on a gimbal or other positioner that includes the necessary mechanization hardware (motors, bearings, etc.) to effect a desired rotation of these axes.

Typically, it is necessary to transition the received and/or transmitted RF signal of the antenna across a rotational axis or axes of the antenna system. To this end, one or more RF rotary joints are frequently employed to effect this transition. Such rotary joints are typically either coaxial or waveguide depending on various design considerations of the specific application, such as frequency of operation, power requirements, packaging constraints, and cost limitations, with both rotary joint classes generally capable of operating over a continuous 360 degrees of rotation.

Due to the use of coax as the primary transmission line basis, coaxial rotary joints are typically more compact, lower cost, and can cover a broader frequency range as compared to waveguide rotary joints. However, coaxial rotary joints exhibit more insertion loss (typically due to the use of dielectric) and have limits as to how much power they can handle.

Waveguide rotary joints, on the other hand, generally exhibit excellent power handling properties as well as low insertion loss due to the inherent low-loss nature of waveguides. Waveguide rotary joints, however, operate over a narrower frequency band (due to the bandwidth limitations of its internal circular waveguide structures), are generally more expensive, and are particularly difficult to fit in volume-limited applications. This is particularly true in positioner designs where space is needed at or near the axis of rotation to accommodate motor drive/bearing components and/or a slip ring (e.g., an electromechanical device used to provide power and signal to other electronic devices mounted on the rotating side of the gimbal/positioner). Such packaging drawbacks are further exacerbated when the rotary joint is required to pass more than one channel (operating band) across the axis of rotation, as this is typically achieved with separate waveguide paths.

SUMMARY OF INVENTION

In view of the aforementioned challenges/shortcomings of currently available technologies, a concentric split ring waveguide rotary joint in accordance with the invention exhibits compact, low-cost, multi-channel properties of coaxial rotary joints, but with the low-loss, high power handling properties of waveguide rotary joints, with the lone drawback of having a small (10°-30°) "blind zone" within the 360 degrees of rotation of the device in which the RF signal will not propagate.

A split ring waveguide rotary joint in accordance with the invention includes two adjacent plates that are rotatable relative to each other. Each plate includes a waveguide portion, the waveguide portions being concentric to one another. Due to the plates being adjacent to one another, the waveguide portions define a waveguide. A first waveguide input/output port is coupled to one waveguide portion and a second waveguide input/output port is coupled to the other waveguide portion, the first and second waveguide input/output ports being communicatively coupled to one another via the waveguide. Relative rotation between the plates changes an angular length of the waveguide that couples the first waveguide input/output port to the second waveguide input/output port.

According to one aspect of the invention, a waveguide rotary joint includes: a first waveguide member comprising a first waveguide portion; a second waveguide member comprising a second waveguide portion, the second waveguide member rotatably connected via a curved circumferential path to the first waveguide member, wherein the second waveguide portion is adjacent to the first waveguide portion to define a first split rectangular waveguide; a first waveguide input/output port communicatively coupled to the first waveguide portion; and a second waveguide input/output port communicatively coupled to the second waveguide portion, wherein relative rotation between the first waveguide member and the second waveguide member changes an angular length of the first waveguide connecting the first waveguide input/output port to the second waveguide input/output port.

Optionally, the first and second waveguide portions comprise curved concentric rectangular waveguide portions.

Optionally, the first and second waveguide members comprise annular rings having the same radius and arranged concentric to one another.

Optionally, the second waveguide member is spaced apart from the first waveguide member by a predefined distance to form an air gap between the first and second waveguide portions.

Optionally, the waveguide rotary joint includes a plurality of waveguide H-bends, wherein each H-bend of the plurality of H-bends couples a respective one of the waveguide input/output ports to a respective waveguide portion.

Optionally, each H-bend of the plurality of H-bends comprises a virtual H-bend element.

Optionally, the virtual H-bend element comprises tuning elements.

Optionally, each H-bend of the plurality of H-bends comprises a protrusion that extends into a waveguide portion of the opposing waveguide member.

Optionally, the waveguide rotary joint includes at least one curved choke feature formed adjacent to and concentric with at least one of the first waveguide member or the second waveguide member, the at least one curved choke feature configured to minimize radio frequency (RF) leakage from the air gap.

Optionally, the at least one curved choke feature comprises a first curved choke portion formed adjacent to and concentric with the first waveguide member and a second curved choke portion formed adjacent to and concentric with the second waveguide member, the first and second curved choke portions concentric with one another.

Optionally, the at least one curved choke feature comprises a plurality of curved choke features that are concentric with one another.

Optionally, the first waveguide member comprises a third waveguide portion and the second waveguide member comprises a fourth waveguide portion, the fourth waveguide portion adjacent to the third waveguide portion to define a second waveguide.

Optionally, the waveguide rotary joint includes: a third input/output port communicatively coupled to the third waveguide portion; a fourth input/output port communicatively coupled to the fourth waveguide portion, wherein relative rotation between the first waveguide member and the second waveguide member changes an angular length of the second waveguide connecting the third input/output port to the fourth input/output port.

Optionally, the waveguide rotary joint includes a damping material arranged in at least a portion of the first or second waveguide portion.

Optionally, each waveguide comprises a rectangular waveguide.

Optionally, relative rotation between the first waveguide member and the second waveguide member changes an angular orientation of the first waveguide input/output port relative to the second waveguide input/output port.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

Figure 1:
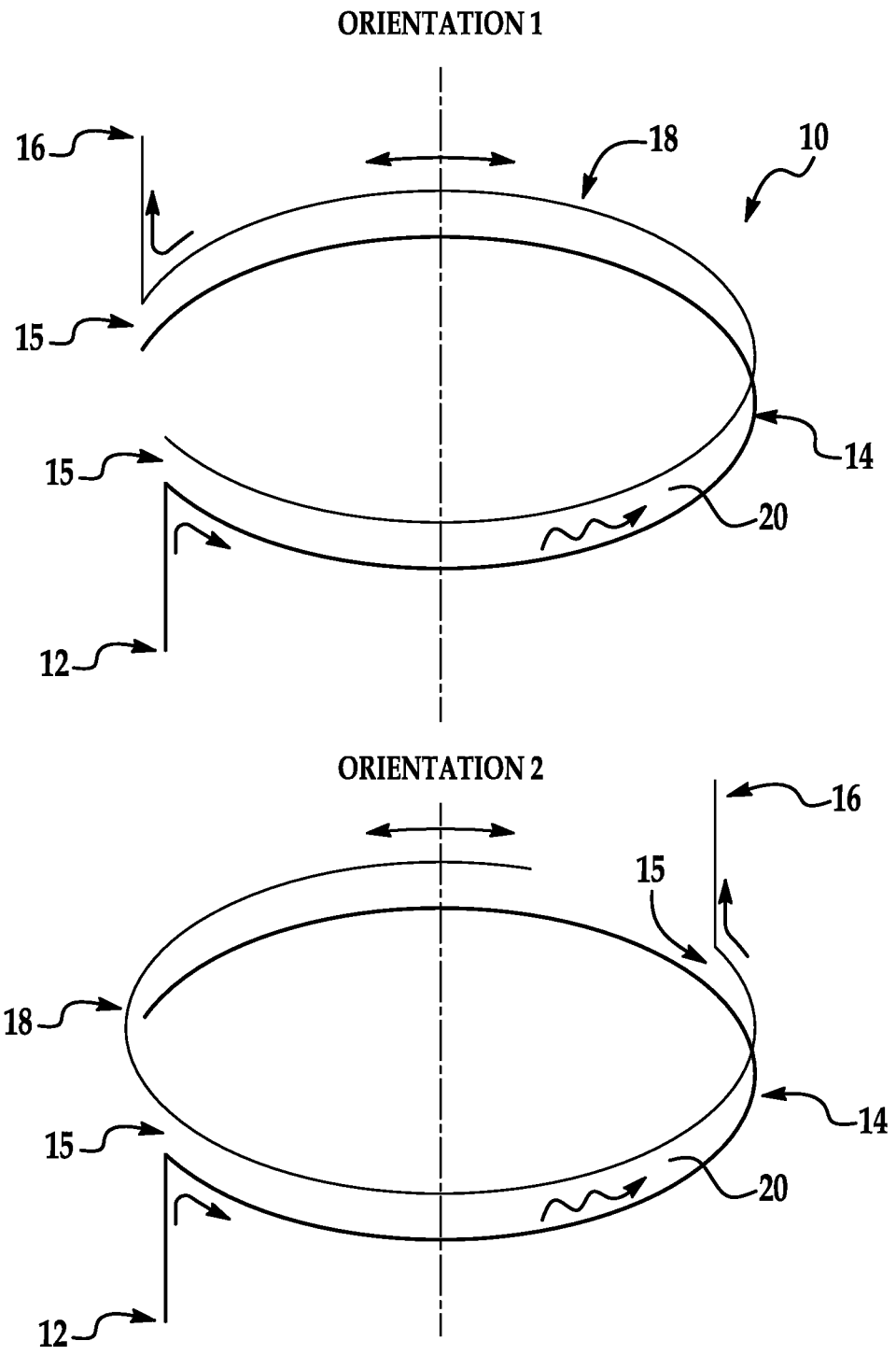
FIG. 1 is a schematic diagram of an exemplary split ring waveguide rotary joint in accordance with the present invention, where two different orientations of the waveguide rotary joint are illustrated.

Packaging essential RF, electronic, and mechanical components in and around the rotational axis of an antenna's gimbal/positioner is a difficult endeavor, as each functional designer can make an equally strong argument for why their component(s) are deserving of occupying this critical space. Most antenna designers either live with the non-ideal packaging limitations and exorbitant manufacturing cost of standard waveguide rotary joints, or alternatively, elect to significantly alter the antenna system architecture by locating the upconversion/downconversion and/or power amplification of the of the RF signal on the rotating side of the antenna system (thereby mitigating the added losses associated with a coaxial rotary joint). This then has the benefit of eliminating the need for a large, expensive waveguide rotary joint, but will typically be achieved at the expense of reliability, weight, and cost due to the increased complexity and size/weight of such components being relocated to the antenna.

Since coaxial rotary joints are typically not an option when low insertion loss is desired and/or if high power operation is a consideration, waveguide rotary joints tend to get priority over other components for use of this prime real estate due to their relatively large size and complex shape (particularly in the case of multi-band rotary joints). However, available volume is not unlimited, so in many cases, multi-band rotary joints are just not practical. In other cases, it may be possible to grow overall system size to accommodate such oversized components. This is clearly not ideal as size/bulk can translate to cost in other areas of the system. On this basis, an axially-compact, efficient, and affordable RF rotary joint is needed.

Most waveguide rotary joints utilize a circular waveguide (i.e., a waveguide having a circular cross-section) as the transmission line medium for transitioning an RF signal from the stationary side of a rotary joint to its rotating side, with the circular waveguide centered on the axis of rotation to exploit its circular symmetry throughout the 360° rotation of the joint. Such an approach necessitates that the rotary joint occupy the space immediately surrounding and along the axis of rotation of the gimbal positioner, preventing other devices from using this space. As a result, waveguide rotary joints tend to be dimensionally large in the axial direction and more compact in the radial direction.

A split ring waveguide rotary joint in accordance with the invention, on the other hand, exclusively uses rectangular waveguide (i.e., a waveguide having a rectangular cross section) as the transmission line medium. The split ring waveguide rotary joint is generally larger in the radial direction (from the axis of rotation) and is more compact in the axial direction. Typically, the joint occupies a "ring shaped" volume spaced radially away from the axis of rotation, leaving the region around the axis of rotation available for other critical components of the system, thereby providing antenna design engineers added design flexibility.

While it is generally true that most waveguide rotary joints utilize rectangular waveguide at some point in the RF path of the device, typically transitioning from circular waveguide to rectangular waveguide at or near the input/output ports of the joint, the split ring waveguide rotary joint in accordance with the invention exploits the fact that transverse internal waveguide currents (which might otherwise "leak") are typically zero at the midpoint of the a-dimension of a rectangular waveguide. This allows the rotary joint to be "split" into two concentric rings, where the waveguide is split down the middle with half of the a-dimension located on the stationary side of the split ring and the other half of the a-dimension located on the rotational side of the split ring. Owing to the aforementioned zero currents at the waveguide a-dimension midpoint, little or no leakage of RF signal occurs at the location of the split.

More specifically, the split ring waveguide rotary joint in accordance with the invention includes curved concentric rectangular waveguide(s) split along the broad wall (a-dimension) utilizing a designed-in airgap between the waveguides. This air gap enables rotational movement between waveguide halves. Curved concentric RF chokes may be optionally employed on both sides of the split concentric rectangular waveguides to further isolate the signals propagating through them and to further suppress any residual leakage in the gap. In some embodiments, the split ring waveguide rotary joint may include virtual (non-penetrating/non-contacting) H-bend(s) utilizing waveguide tuning elements (tuners) and microwave load material to efficiently transition the RF signal propagating in the split rectangular waveguide from/to the waveguide input port and waveguide output port. This allows for the free-rotation of the mechanism. Alternative penetrating H-bend(s), may also be included. The penetrating H-bend embodiment has the drawback of extending into the opposing waveguide, risking damage during rotation. However, the penetrating H-bend embodiment provides broader bandwidth performance (as compared to the virtual H-bend approach) if needed for certain applications.

The concentric waveguide chokes also can be split in half, similar to how the concentric waveguides are split between the two rotating parts. Alternatively, the concentric waveguide chokes can be solely located on one side of the split ring to achieve the same choking function depending on packaging needs/constraints. The waveguide chokes used in and around the H-bend of the penetrating H-bend variant, on the other hand, should be located solely on the waveguide port side of the split ring to achieve their purpose of mitigating leakage in and around the penetrating H-bend.

Referring now to FIG. 1, illustrated is a schematic representation of a split ring waveguide rotary joint 10 in accordance with the invention, where a top portion of FIG. 1 illustrates the rotary joint 10 in a first orientation and a bottom portion of FIG. 1 illustrates the rotary joint 10 in a second orientation. The split ring waveguide rotary joint 10 includes a first waveguide input/output (I/O) port 12 coupled to a first (bottom) waveguide member 14 via virtual H-bends 15, and a second waveguide I/O port 16 coupled to a second (top) waveguide member 18 via virtual H-bends 19. As will be described in more detail below, the respective waveguide members 14 and 18 include corresponding waveguide portions that define a waveguide 20 connecting the waveguide I/O ports 12 and 16 to one another.

A signal propagates from the first waveguide I/O port 12, through the first H-bend 15, along the split rectangular waveguide 20, through the second H-bend 15, and then out the second waveguide I/O port 16, with the only difference between the two rotational orientations being the line length of the split rectangular waveguide section.

As can be seen in FIG. 1, regardless of the orientation of the waveguide rotary joint 10, a signal entering the waveguide I/O port 12 passes through the same waveguide 20 and exits through the waveguide I/O port 16. However, depending on the orientation, the angular (circumferential) length of the waveguide 20 from one orientation to the other changes, thus accommodating a different (variable) output location.

Figure 2:
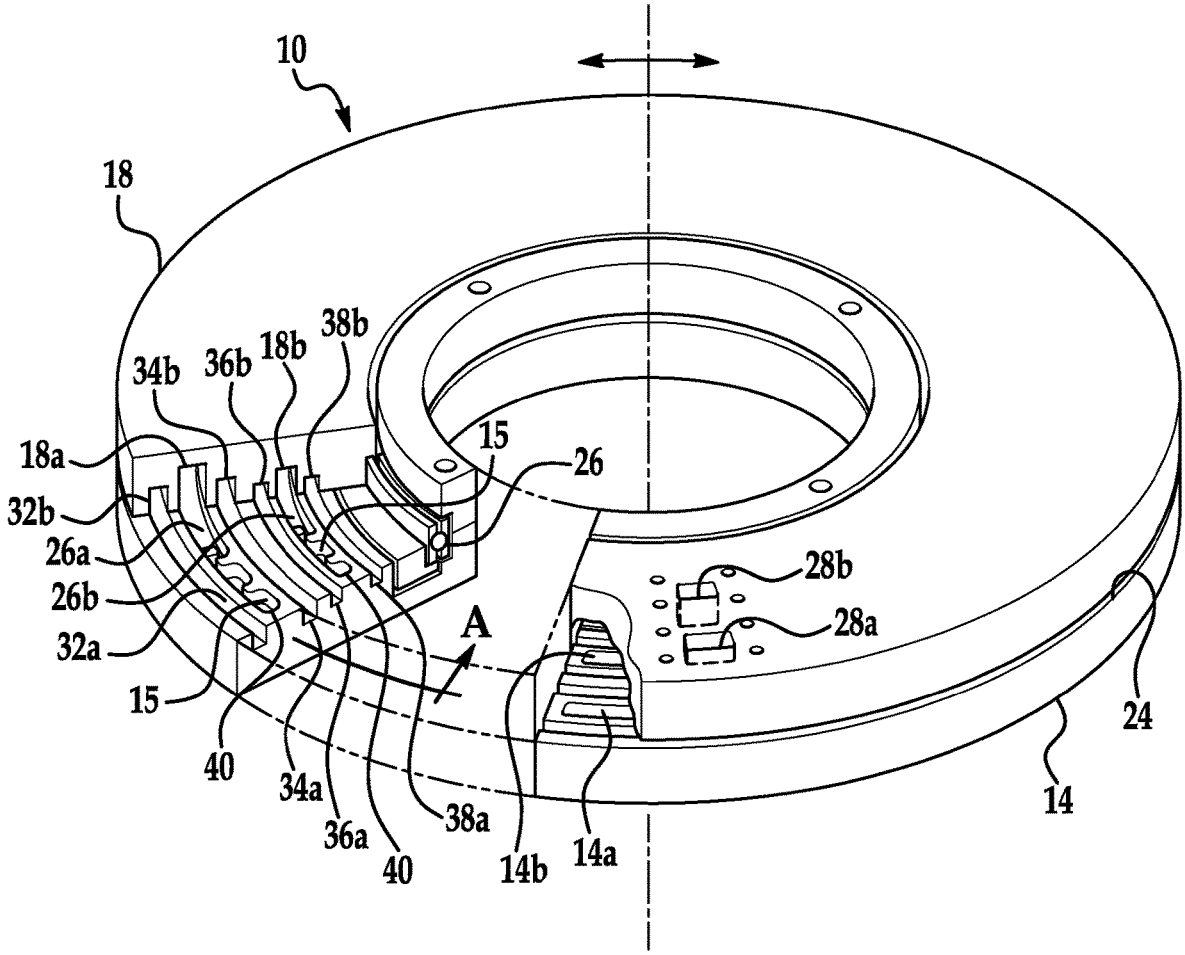
FIG. 2 is a perspective view with a partial cutaway of an exemplary spilt ring waveguide rotary joint in accordance with the present invention.
Figure 3:
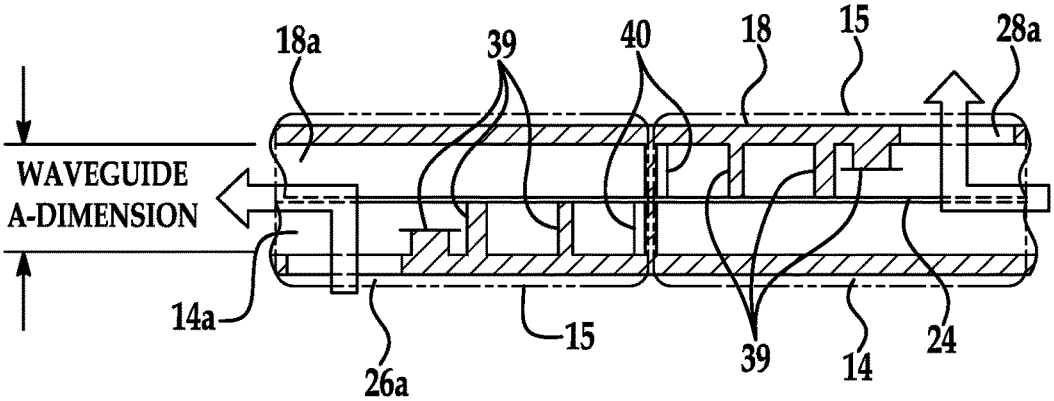
FIGS. 3 and 4 are straightened sectional views of the split ring waveguide of FIG. 2 showing maximum clockwise rotation and maximum counter-clockwise rotation, respectively.
Figure 4:
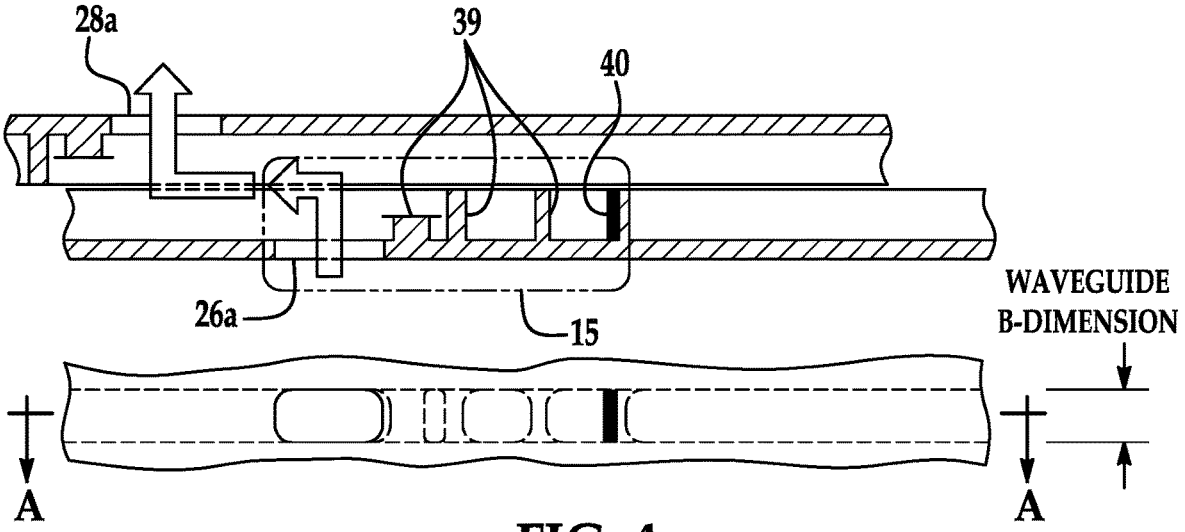
Figure 5:
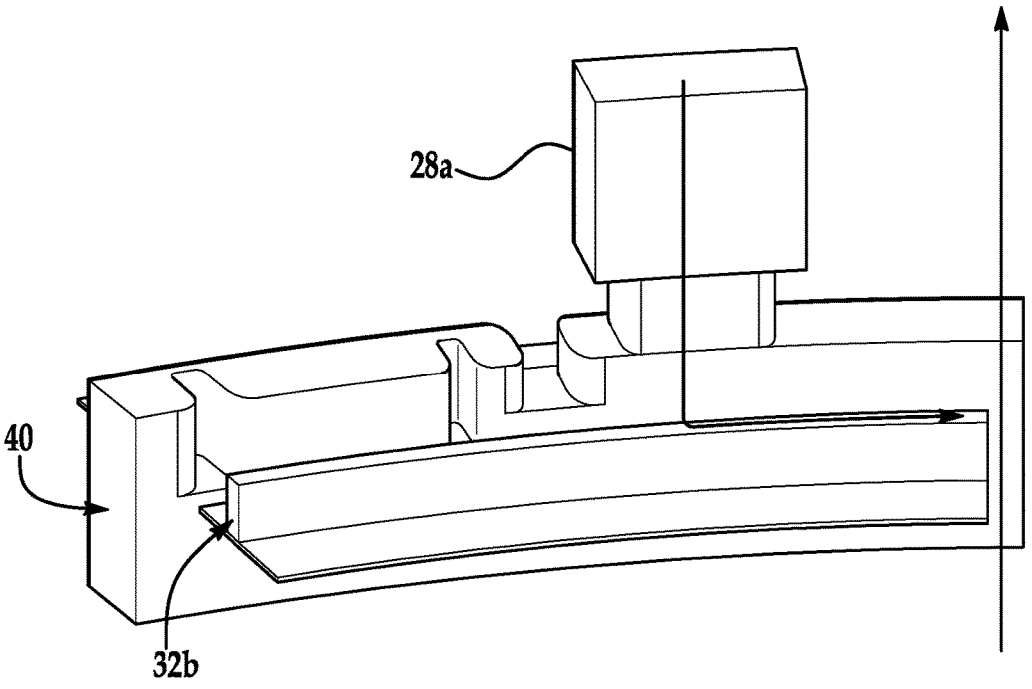
FIG. 5 is a perspective view of the air space of a portion of the split ring waveguide rotary joint in accordance with the invention simulating the air space of the invention.
Figure 6A:
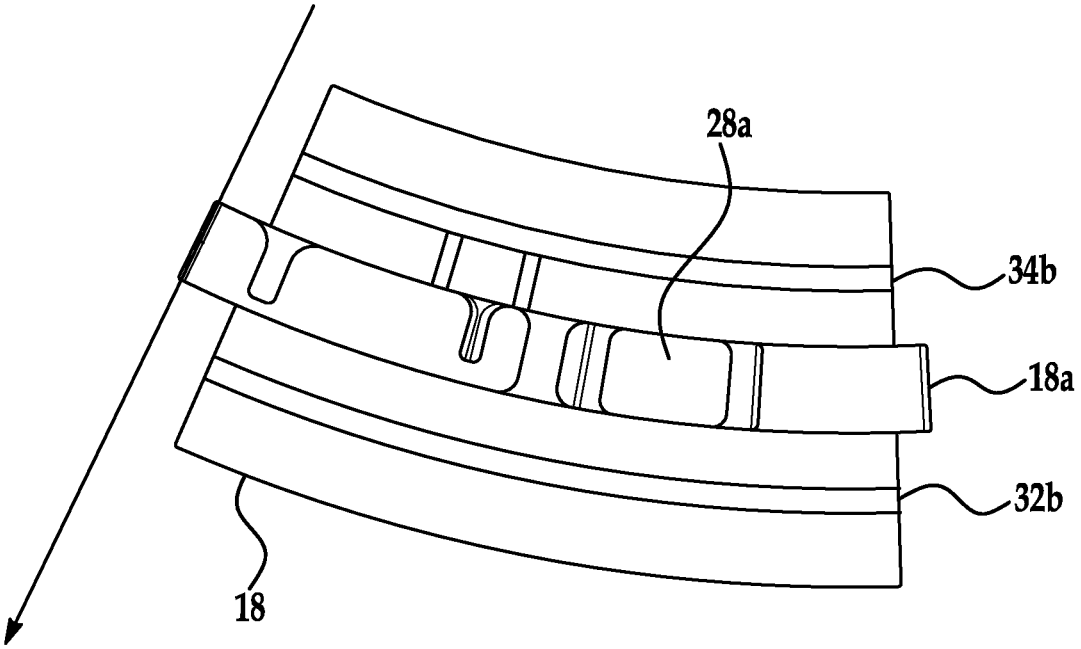
FIGS. 6A and 6B are bottom and top views of the air space of a portion of the split ring waveguide rotary joint in accordance with the invention.
Figure 6B:
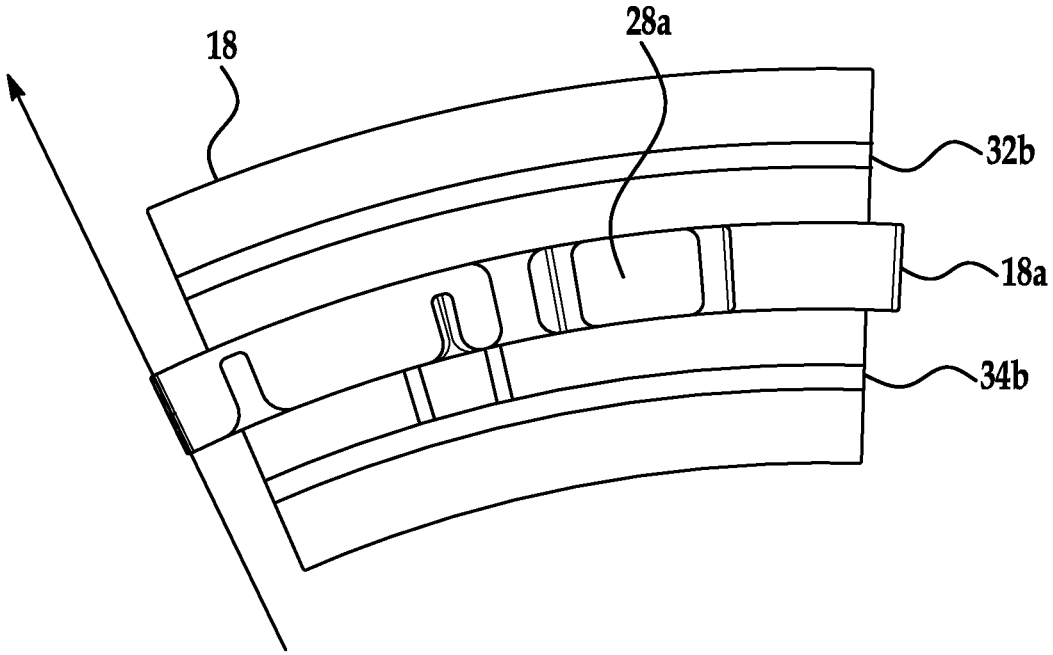

With additional reference to FIGS. 2-6, illustrated are a partial cutaway view, sectional views and perspective views of an exemplary split ring waveguide rotary joint 10 in accordance with the invention. In contrast to the single-band embodiment shown in the schematic of FIG. 1, the embodiment of FIGS. 2-6 is multi-band that is operative with low-frequency band signals and high-frequency band signals. The exemplary waveguide rotary joint 10 includes a first (lower) waveguide member 14 and a second (upper) waveguide member 18 that is rotatable relative to the first waveguide member 14. Preferably, the waveguide members 14 and 18 are embodied as rings or disks that are arranged concentric with one another as shown in FIG. 2, as such configuration permits easy rotation of one member relative to the other without the risk of interference from other structures that may be near the waveguide rotary joint 10.

The first waveguide member 14 includes a first low-frequency rectangular waveguide portion 14*a* (a first waveguide portion) and a first high-frequency rectangular waveguide portion 14*b* (a third waveguide portion). In this regard, a "waveguide portion" is part of a waveguide (i.e., less than the entire waveguide), such as a lower half of the waveguide. Similarly, the second (upper) waveguide member 18 includes a second low-frequency rectangular waveguide portion 18*a* (a second waveguide portion) and a second high-frequency rectangular waveguide portion 18*b* (a fourth waveguide portion), the second waveguide portions 18*a* and 18*b* arranged adjacent to the first waveguide portions 14*a* and 14*b* to define respective low-frequency and high-frequency waveguides. The respective waveguide portions 14*a*, 14*b*, 18*a*, 18*b* can be formed as curved concentric rectangular waveguide portions that define a rectangular waveguide.

The second waveguide member 18 is rotatably coupled to the first waveguide member 14 and separated therefrom by a predefined distance to form an air gap 24. In the illustrated embodiment of FIG. 2 the physical connection between the first and second waveguide members 14 and 18 is via a bearing assembly 26, although other physical connection means may be employed such as a bushing or the like.

Since in a split waveguide configuration a high-frequency signal is more prone to leakage at the split (air gap 24) than a low-frequency signal, preferably the high-frequency waveguide portions 14*b*, 18*b* are located closer to the axis of rotation of the rotary joint 10 than the low-frequency waveguide portions 14*a*, 18*a*. By locating the high-frequency waveguide portions 14*b*, 18*b* closer to the axis of rotation the overall length of the waveguide through which the high-frequency signal propagates is minimized and thus the chance of leakage of a high-frequency signal through the air gap 24 is reduced.

The split ring waveguide rotary joint 10 also includes a first low-frequency waveguide I/O port 26*a* (a first waveguide I/O port) communicatively coupled to the first low-frequency waveguide portion 14*a* and a first high-frequency waveguide I/O port (a third waveguide I/O port) 26*b* communicatively coupled to the first high-frequency portion 14*b*. Similarly, the split ring waveguide rotary joint 10 includes a second low-frequency waveguide I/O port 28*a* (a second waveguide I/O port) communicatively coupled to the second low-frequency waveguide portion 18*a* and a second high-frequency waveguide I/O port 28*b* (a fourth waveguide I/O port) communicatively coupled to the second high-frequency portion 18*b*. Relative rotation between the first waveguide member 14 and the second waveguide member 18 changes an angular length of the waveguides connecting the first low-frequency waveguide I/O port 26*a* to the second low-frequency waveguide I/O port 28*a*, as well as the angular length of the waveguide connecting the first high-frequency waveguide I/O port 26*b* to the second high-frequency waveguide I/O port 28*b*.

Each waveguide I/O port 26*a*, 26*b*, 28*a*, 28*b* may include a respective waveguide H-bend 15 that couples the waveguide I/O port 26*a*, 26*b*, 28*a*, 28*b* to the respective waveguide portion 14*a*, 14*b*, 18*a*, 18*b*. In the embodiment of FIGS. 2-6 the H-bend is a virtual (i.e., non-contacting, non-penetrating) H-bend that includes tuning elements 39 (e.g., features that can be used to selectively filter signals by frequency) that when appropriately sized and positioned in the portion of waveguide containing the waveguide I/O port, favorably reflects, guides, and ultimately couples RF energy from the waveguide I/O port to the respective waveguide portion. The tuning elements may be comprised of one or more individual discrete features realized as grooves and walls 39 adjacent to each of the two waveguide ports 26*a* and 28*a* and forming the respective virtual H-bends 15. The depths, heights, and positions of these features relative to each other and relative to each waveguide port are selected in order to favorably create multiple RF reflections which redirect (reflect) RF energy that would otherwise undesirably pass or leak past the waveguide ports, such that this reflected RF energy instead constructively adds to the incoming RF energy from the waveguide sections 14*a*, 14*b*, effectively "bending" the RF propagation path (by 90 degrees in the "H-plane" of the waveguide fields) and thereby "virtually" transferring substantially 100% of the RF energy from the waveguide to the adjoining waveguide port(s) and without physical connection nor penetration between the two halves 14 and 18.

However, other type of H-bends may be used, such as penetrating H-bends as discussed below with respect to FIGS. 7-8. A conventional ("real") waveguide H-bend is defined as a rigid two-port device for which incoming RF signals from one direction are reoriented ("bent") to a different direction generally oriented 90° from the original direction. In the case of an H-bend, this bending is accomplished in the H-plane (magnetic field plane) of the rectangular waveguide. A "virtual" H-bend, on the other hand, accomplishes this same function, but with the waveguide structure "split" into two separate non-contacting pieces.

Each waveguide portion of the waveguide rotary joint may also include a RF load material 40 arranged in at least a portion of the first or second waveguides in the region of the H-bends 15. The load RF material 40, typically composed of carbon or iron, acts as a damper to dampen any possible RF resonances between the opposing H-bends.

The waveguide rotary joint 10 can include a first curved choke feature formed in at least one of the first waveguide member 14 or the second waveguide member 18. The curved choke feature minimizes radio frequency (RF) leakage through the air gap 24. In one embodiment, the curved choke feature is formed from a first curved choke portion 32*a* in the first waveguide member 14 and a second curved choke portion 32*b* in the second waveguide member 18, where the first and second curved choke portions 32*a*, 32*b* are concentric with one another. Preferably, a plurality of choke features are formed in the waveguide rotary joint 10. For example, choke features can be formed on each side of a waveguide. Thus, in the embodiment of FIG. 2 in which two waveguides are present (defined by the first and second low-frequency portions 14*a*, 18*a* and the first and second high-frequency portions 14*b*, 18*b*), four choke features may be formed in the waveguide rotary joint 10 (e.g., the choke features being defined by the choke portions 32*a*, 32*b*, 34*a*, 34*b*, 36*a*, 36*b* and 38*a*, 38*b*). The respective choke features may be arranged concentric with one another. Although this particular embodiment employs two different frequencies for the two channels, identical common frequencies for both channels are equally viable.

Figure 7:
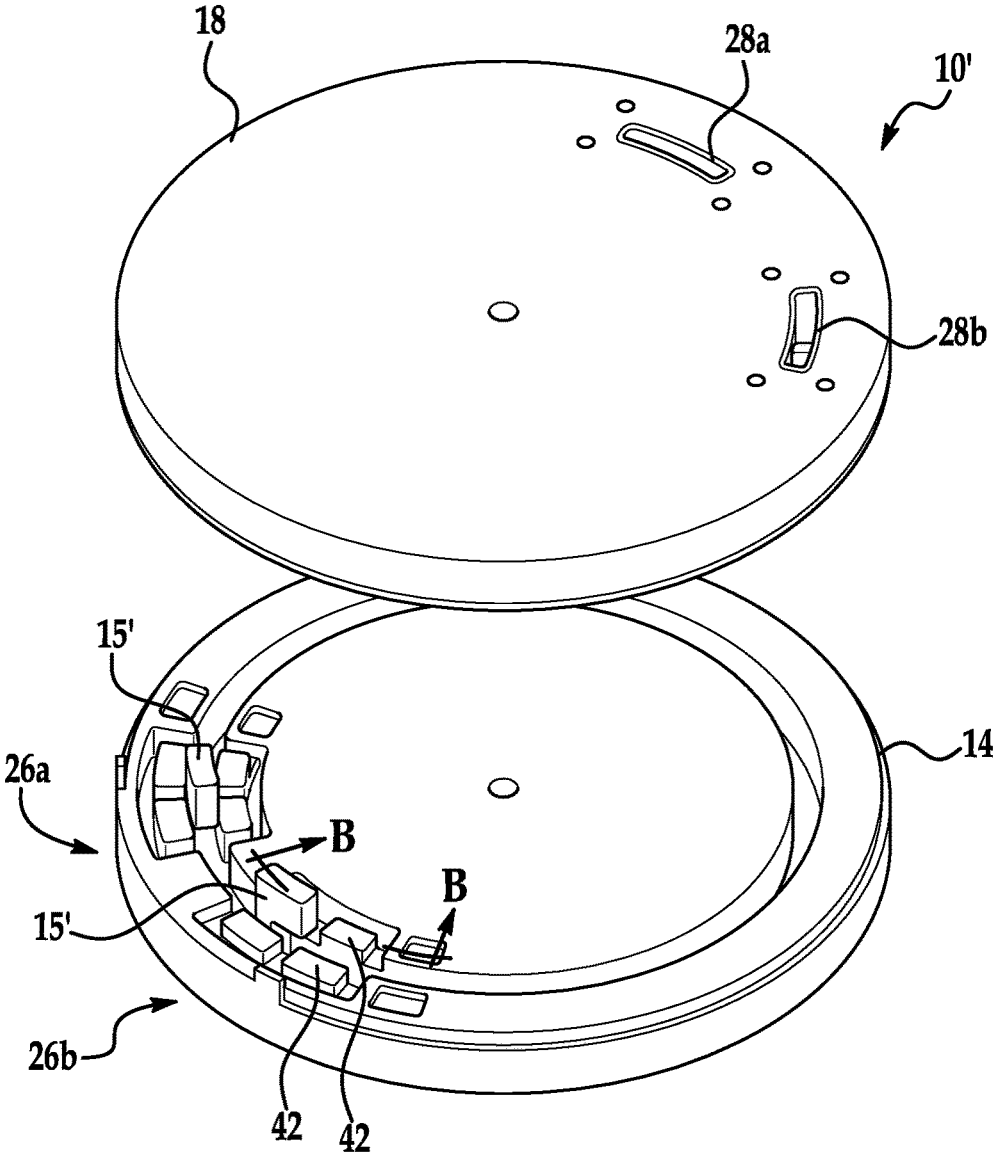
FIG. 7 is an exploded view of another exemplary split ring waveguide rotary joint in accordance with the invention illustrating a penetrating, non-contacting H-bend.
Figure 8:
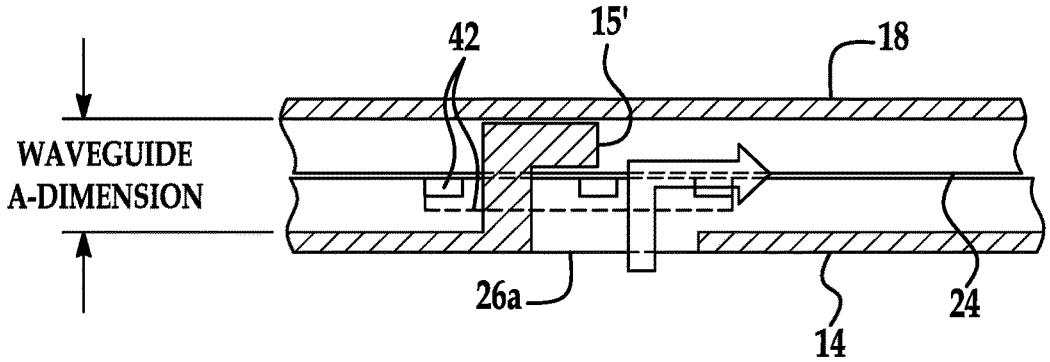
FIG. 8 is a straightened section view of the penetrating, non-contacting H-bend of FIG. 7.

Moving now to FIGS. 7 and 8, illustrated is a split ring waveguide rotary joint 10' in accordance with another embodiment of the invention. The rotary joint 10' is similar to the rotary joint 10 of FIGS. 2-6, but instead of a virtual H-bend at the waveguide I/O ports the embodiment of FIGS. 7 and 8 implements protruding H-bends 15' at the waveguide I/O ports. As best seen in FIG. 8, a protruding H-bend includes a protrusion that extends from the first (lower) waveguide member 14 and into a waveguide portion of the second (upper) waveguide member 18. The protruding concept may also be applied to the chokes of the rotary joint 10'. For example, a protrusion 42 of choke portion 32*a* in the first waveguide member 14 may protrude into the corresponding choke portion 32*b* of the second waveguide member 18. Another feature of the split ring waveguide rotary joint embodiment shown in FIGS. 7 and 8 is that the same radius is used by separate waveguide changes, providing an additional option for further compacting two RF channels in applications where less than 180° of rotation is needed between rotating elements. A benefit of the "protruding" approach is generally a moderately broader operating bandwidth as compared to a "non-protruding" version, as there is less reliance on the frequency-sensitive choke and tuning details associated with the latter. The protrusion is a surrogate for the angled "miter" feature employed in waveguide bend components (including traditional "real" contacting H-bends).

The split ring rotary joint can be used in a number of communications and radar applications in which at least one RF signal is transitioned from one device to another across a rotational axis. Such applications can include radar tracking, synthetic aperture radars, radar sensors, satellite communications, air-to-air communications, and air-to-ground communications, and may utilize single or multiple RF channels.

With the exception of having an operational "dead zone" of approximately 10 to 30 degrees of rotation (depending on frequency of operation, distance from axis of rotation), the split ring waveguide rotary joint in accordance with the invention combines most of the benefits of coaxial and waveguide rotary joints while exhibiting few of their drawbacks. The inventive rotary joint offers an affordable approach of integrating multiple rotary joint channels within the adjacent gimbal/positioner structure, leaving the volume in the vicinity of the rotational axis open for other critical antenna subsystem components (e.g. slip ring, motor, encoder, etc.). This eliminates the need for a rotary-joint-specific bearing and enables the use of affordable manufacturing methods (e.g. machining, injection molding) owing to the nearly 2-dimensional form factor of the two primary parts employed to construct the rotary joint path(s) and ports.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A waveguide rotary joint, comprising:

a first waveguide member comprising a first waveguide portion;

a second waveguide member comprising a second waveguide portion, the second waveguide member rotatably connected via a curved circumferential path to the first waveguide member, wherein the second waveguide portion is adjacent to the first waveguide portion to define a first split waveguide;

a first waveguide input/output port communicatively coupled to the first waveguide portion; and a second waveguide input/output port communicatively coupled to the second waveguide portion, wherein relative rotation between the first waveguide member and the second waveguide member changes an angular length of the first split waveguide connecting the first waveguide input/output port to the second waveguide input/output port.

2. The waveguide rotary joint according to claim 1, wherein the first and second waveguide portions comprise curved concentric rectangular waveguide portions.

3. The waveguide rotary joint according to claim 1, wherein the first and second waveguide members comprise annular rings having the same radius and arranged concentric to one another.

4. The waveguide rotary joint according to claim 1, wherein the second waveguide member is spaced apart from the first waveguide member by a predefined distance to form an air gap between the first and second waveguide portions.

5. The waveguide rotary joint according to claim 1, further comprising a plurality of waveguide H-bends, wherein each H-bend of the plurality of H-bends couples a respective one of the waveguide input/output ports to a respective waveguide portion.

6. The waveguide rotary joint according to claim 5, wherein each H-bend of the plurality of H-bends comprises a virtual H-bend element.

7. The waveguide rotary joint according to claim 6, wherein the virtual H-bend element comprises tuning elements.

8. The waveguide rotary joint according to claim 6, wherein each H-bend of the plurality of H-bends comprises a protrusion that extends into a waveguide portion of the opposing waveguide member.

9. The waveguide rotary joint according to claim 1, further comprising at least one curved choke feature formed adjacent to and concentric with at least one of the first waveguide member or the second waveguide member, the at least one curved choke feature configured to minimize radio frequency (RF) leakage from the air gap.

10. The waveguide rotary joint according to claim 9, wherein the at least one curved choke feature comprises a first curved choke portion formed adjacent to and concentric with the first waveguide member and a second curved choke portion formed adjacent to and concentric with the second waveguide member, the first and second curved choke portions concentric with one another.

11. The waveguide rotary joint according to claim 9, wherein the at least one curved choke feature comprises a plurality of curved choke features that are concentric with one another.

12. The waveguide rotary joint according to claim 1, wherein the first waveguide member comprises a third waveguide portion and the second waveguide member comprises a fourth waveguide portion, the fourth waveguide portion adjacent to the third waveguide portion to define a second split waveguide.

13. The waveguide rotary joint according to claim 12, further comprising:

a third input/output port communicatively coupled to the third waveguide portion;

a fourth input/output port communicatively coupled to the fourth waveguide portion, wherein the relative rotation between the first waveguide member and the second waveguide member changes an angular length of the second split waveguide connecting the third input/output port to the fourth input/output port.

14. The waveguide rotary joint according to claim 12, wherein the second split waveguide comprises a rectangular waveguide.

15. The waveguide rotary joint according to claim 1, wherein the first split waveguide comprises a rectangular waveguide.

16. The waveguide rotary joint according to claim 1, wherein the relative rotation between the first waveguide member and the second waveguide member changes an angular orientation of the first waveguide input/output port relative to the second waveguide input/output port.

17. The waveguide rotary joint according to claim 1, further comprising a damping material arranged in at least a portion of the first or second waveguide portion.

* * * * *